US007611265B2

(12) United States Patent
Laporte

(10) Patent No.: US 7,611,265 B2
(45) Date of Patent: Nov. 3, 2009

(54) SEALED ACORN LUMINAIRE HAVING A ONE-WAY OUTFLOW SEAL AND A ONE-WAY INFLOW ELECTRICAL GROMMET SEAL

(75) Inventor: Jean Francois Laporte, Boisbriand (CA)

(73) Assignee: Lumec, Inc., Boisbriand (CA)

( * ) Notice: Subject to any disclaimer, the term of this patent is extended or adjusted under 35 U.S.C. 154(b) by 108 days.

(21) Appl. No.: 11/679,645

(22) Filed: Feb. 27, 2007

(65) Prior Publication Data

US 2008/0205069 A1 Aug. 28, 2008

(51) Int. Cl.
*F21V 29/00* (2006.01)

(52) U.S. Cl. ..... 362/267; 362/363; 362/374; 362/427

(58) Field of Classification Search ..... 362/158, 362/267, 350, 362, 363, 431, 457, 96, 186, 362/645, 311, 427, 264, 294, 373, 276, 569, 362/374–375

See application file for complete search history.

(56) References Cited

U.S. PATENT DOCUMENTS

| | | | |
|---|---|---|---|
| D51,774 | S | 2/1918 | Coppinger |
| 1,357,539 | A | 11/1920 | Bissell |
| 1,702,746 | A | 2/1929 | Prichard |
| 2,080,120 | A | 5/1937 | Everett |
| 2,758,199 | A | 8/1956 | Yonkers |
| 2,960,361 | A | 11/1960 | Boutelle |
| 3,040,994 | A | 6/1962 | Anderson et al. |
| 3,202,070 | A | 8/1965 | Pratt, Jr. et al. |
| 3,299,265 | A | 1/1967 | Rackley et al. |
| 3,299,591 | A | 1/1967 | Woelk |
| 3,347,008 | A | 10/1967 | Strengholt |
| 3,413,462 | A | 11/1968 | Spero |
| 3,461,283 | A | 8/1969 | Hahn |
| 3,529,148 | A | 9/1970 | Stefano et al. |
| 3,543,016 | A | 11/1970 | Jones |
| 3,701,898 | A | 10/1972 | McNamara, Jr. |
| 3,711,702 | A | 1/1973 | Adra |
| 3,940,898 | A | 3/1976 | Kaufman |
| 3,990,201 | A | 11/1976 | Falbel |
| 3,991,905 | A | 11/1976 | Nicpon |
| 4,001,778 | A | 1/1977 | Ross |
| 4,015,394 | A | 4/1977 | Kessler |
| 4,027,151 | A | 5/1977 | Barthel |
| 4,029,630 | A | 6/1977 | Meinhold et al. |
| 4,090,210 | A | 5/1978 | Wehling et al. |
| 4,141,061 | A | 2/1979 | Ford et al. |
| 4,143,412 | A | 3/1979 | Sassmannshausen |

(Continued)

FOREIGN PATENT DOCUMENTS

| | | | |
|---|---|---|---|
| GB | 2062958 | A * | 5/1981 |

*Primary Examiner*—Anabel Ton
*Assistant Examiner*—Kevin Spinella
(74) *Attorney, Agent, or Firm*—John F. Salazar; Middleton Reutlinger

(57) ABSTRACT

An sealed acorn style luminaire is described. The luminaire has generally separate inflow and outflow valves for pressure equalization in order to minimize the amount of dust and other foreign matter which could enter into the sealed optical compartment thereby reducing the optical characteristics of the fixture. A one way outflow valve and seal is provided in combination with controlled inflow seals to reduce or limit the dirt and other foreign substances in the sealed optical compartment.

21 Claims, 6 Drawing Sheets

U.S. PATENT DOCUMENTS

| | | | | |
|---|---|---|---|---|
| 4,143,413 | A | | 3/1979 | Kelly |
| 4,155,111 | A | | 5/1979 | Kelly et al. |
| 4,164,784 | A | | 8/1979 | Jaksich |
| 4,173,037 | A | | 10/1979 | Henderson, Jr. et al. |
| 4,213,170 | A | | 7/1980 | Kimball et al. |
| 4,218,727 | A | | 8/1980 | Shemitz et al. |
| 4,229,782 | A | | 10/1980 | Ruud et al. |
| 4,240,853 | A | | 12/1980 | Pustka |
| 4,242,725 | A | | 12/1980 | Douma et al. |
| 4,261,030 | A | | 4/1981 | Hernandez |
| 4,293,901 | A | | 10/1981 | Hernandez |
| 4,310,876 | A | | 1/1982 | Small, Jr. et al. |
| 4,318,237 | A | | 3/1982 | Hicks |
| 4,323,954 | A | | 4/1982 | Florence et al. |
| 4,323,956 | A | | 4/1982 | Pustka |
| 4,364,108 | A | | 12/1982 | Rapp |
| 4,447,863 | A | | 5/1984 | Fenne |
| 4,450,660 | A | | 5/1984 | Dean et al. |
| 4,459,789 | A | | 7/1984 | Ford |
| 4,480,809 | A | | 11/1984 | Healey |
| 4,527,224 | A | | 7/1985 | Sangiamo et al. |
| 4,531,180 | A | | 7/1985 | Hernandez |
| 4,546,420 | A | | 10/1985 | Wheeler et al. |
| 4,602,320 | A | | 7/1986 | Tomkin et al. |
| 4,626,975 | A | | 12/1986 | Miletich |
| 4,717,991 | A | | 1/1988 | Murphree, Jr. |
| 4,766,709 | A | | 8/1988 | Galbraith |
| 4,786,344 | A | | 11/1988 | Beuther |
| 4,816,969 | A | | 3/1989 | Miller |
| 4,893,224 | A | | 1/1990 | Tinley |
| 5,016,150 | A | | 5/1991 | Gordin et al. |
| 5,111,371 | A | | 5/1992 | Nielson |
| 5,140,507 | A | | 8/1992 | Harwood |
| 5,183,331 | A | | 2/1993 | Edgell et al. |
| 5,278,737 | A | | 1/1994 | Luce et al. |
| 5,377,087 | A | | 12/1994 | Yoon |
| 5,404,297 | A | | 4/1995 | Birk et al. |
| 5,435,087 | A | | 7/1995 | Karkar et al. |
| 5,446,637 | A | | 8/1995 | Cunningham et al. |
| 5,450,303 | A | | 9/1995 | Markiewicz et al. |
| D370,228 | S | | 5/1996 | Chapman et al. |
| 5,572,819 | A | | 11/1996 | Topinka et al. |
| 5,642,934 | A | | 7/1997 | Haddad |
| 5,704,710 | A | | 1/1998 | Greene et al. |
| 5,722,770 | A | | 3/1998 | Douglas |
| 5,743,632 | A | | 4/1998 | Carl |
| 5,743,634 | A | * | 4/1998 | Sitzema et al. ..... 362/341 |
| 5,826,975 | A | | 10/1998 | Hsieh et al. |
| 6,017,131 | A | | 1/2000 | Goins |
| D424,736 | S | | 5/2000 | Johnson |
| 6,402,352 | B1 | | 6/2002 | Summerford et al. |
| 6,450,657 | B1 | | 9/2002 | Testa et al. |
| D469,565 | S | | 1/2003 | Anderson et al. |
| 6,840,658 | B2 | | 1/2005 | Anderson et al. |
| 6,953,267 | B1 | * | 10/2005 | Cunningham ..... 362/267 |
| 7,059,747 | B2 | | 6/2006 | Barozzini et al. |
| 7,121,684 | B2 | | 10/2006 | Barozzini et al. |
| 7,210,827 | B1 | * | 5/2007 | Haddad ..... 362/375 |
| 2005/0117333 | A1 | | 6/2005 | Yoshida et al. |
| 2006/0279951 | A1 | * | 12/2006 | Hagen et al. ..... 362/267 |

* cited by examiner

SEALED ACORN LUMINAIRE HAVING A ONE-WAY OUTFLOW SEAL AND A ONE-WAY INFLOW ELECTRICAL GROMMET SEAL

FIELD OF THE INVENTION

The present invention is related to outdoor luminaires and in particular to outdoor lighting or street lighting wherein the luminaire optical system is fully sealed to prevent the intrusion of dirt, dust and other materials which would reduce luminaire lumen output.

BACKGROUND OF THE INVENTION

Outdoor luminaires which are utilized for wide area lighting or street lighting face many challenges during the life of the luminaire. Due to the environmental circumstances and conditions in which the luminaires are utilized, and due to the extensive heating and cooling cycles inflicted upon the electrical and optical system of the luminaire, dirt, dust and moisture intrusion commonly occur into the electrical and optical system thereby affecting the lighting characteristics of the luminaire over time. The penetration of these foreign substances into the luminaire therefore must be taken into account during the design phase of the reflector and light system in order to maintain continued output characteristics over a given length of time. Penetration ratings are provided in order to describe the ability for luminaire housings as well as various optical systems to resist the penetration of both solids and liquids into the sealed compartment defining the optical area. These intrusion protection or ingress protection ratings are designed to help gauge the ability for the seals to inhibit dirt and other foreign material from entering into the luminaire and causing potential performance loss. Commonly, outdoor luminaires have interpenetration protection ratings (IP) in order to gauge the performance of the seals and their ability to prevent dirt and foreign substance intrusion. Intrusion by both foreign substances such as dirt and water on the lenses and other reflective elements of the luminaire affects the performance of the lighting system. The luminaire dirt depreciation for particular conditions in which the luminaire will be installed thus comes in handy to determine overall light loss and maintenance required in order to maintain the luminance or illumination level of the luminaire. By preventing the intrusion of moisture or other foreign substances into the optical system, lower initial lumen output and therefore lower wattage lamps, may be utilized.

It is thus desirable to provide an outdoor luminaire which has adequate seals which prevent contaminates such as dust, soot or moisture to collect on the optical system surfaces. This is particularly the case given that these sealed compartments or optical systems undergo intense heating and cooling cycles, thereby changing the pressure differential between the sealed interior space defined within the globe or other optical system area and exterior of the globe, as can be commonly understood. When activated, the lamp causes intense heat within the optical area thereby increasing the air pressure therein and creating a positive pressure system between the sealed internal area or compartment of the luminaire and the exterior area. During cooling, a reverse air pressure system ensues thereby exerting opposite pressure on the seals of the sealed compartment while the system cools thereby allowing inflow of contaminates and other material into the sealed compartment. It is thus desirable to provide a sealed outdoor luminaire which has adequate seals which allow outflow of air from inside the globe or optical area during intense heating and which restricts the inflow of contaminates and other material into the luminaire compartment during the cooling cycle or other negative pressure event.

Interpenetration protection ratings for luminaires are often quoted as indicated above for lighting enclosures and luminaires and indicate protection from solids, liquids and impact. Various standards are known for describing the ratings and typically, the IP rating is given with two numbers, the first number indicating the protection against solids while the second number indicating the protection against liquids. It is desirable to provide an IP rating of a luminaire over its lifetime of a minimum of IP66 indicting that there is total protection against dust intrusion and also high protection against liquids. Various other IP ratings may be implemented as it is significantly desirable to provide intrusion protection of dust and other contaminates in the interior portion of the optical area, the optical system of a luminaire including the lamp or other light generating mechanism or component, baffles, shields, reflectors and other elements located within the globe and including the globe.

DETAILED DESCRIPTION OF THE PREFERRED EMBODIMENTS

Figure 1:
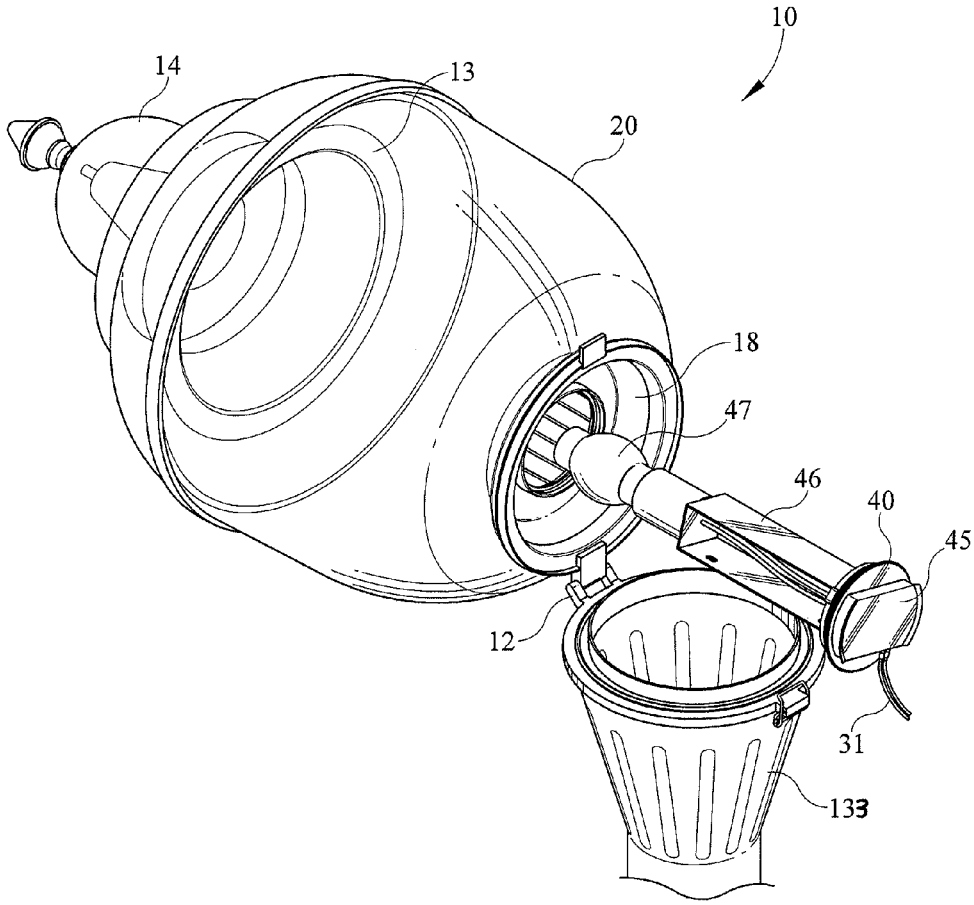
FIG. 1 is a perspective view of the sealed acorn luminaire of the present invention wherein the globe is opened and the lamp has been removed.
Figure 5:
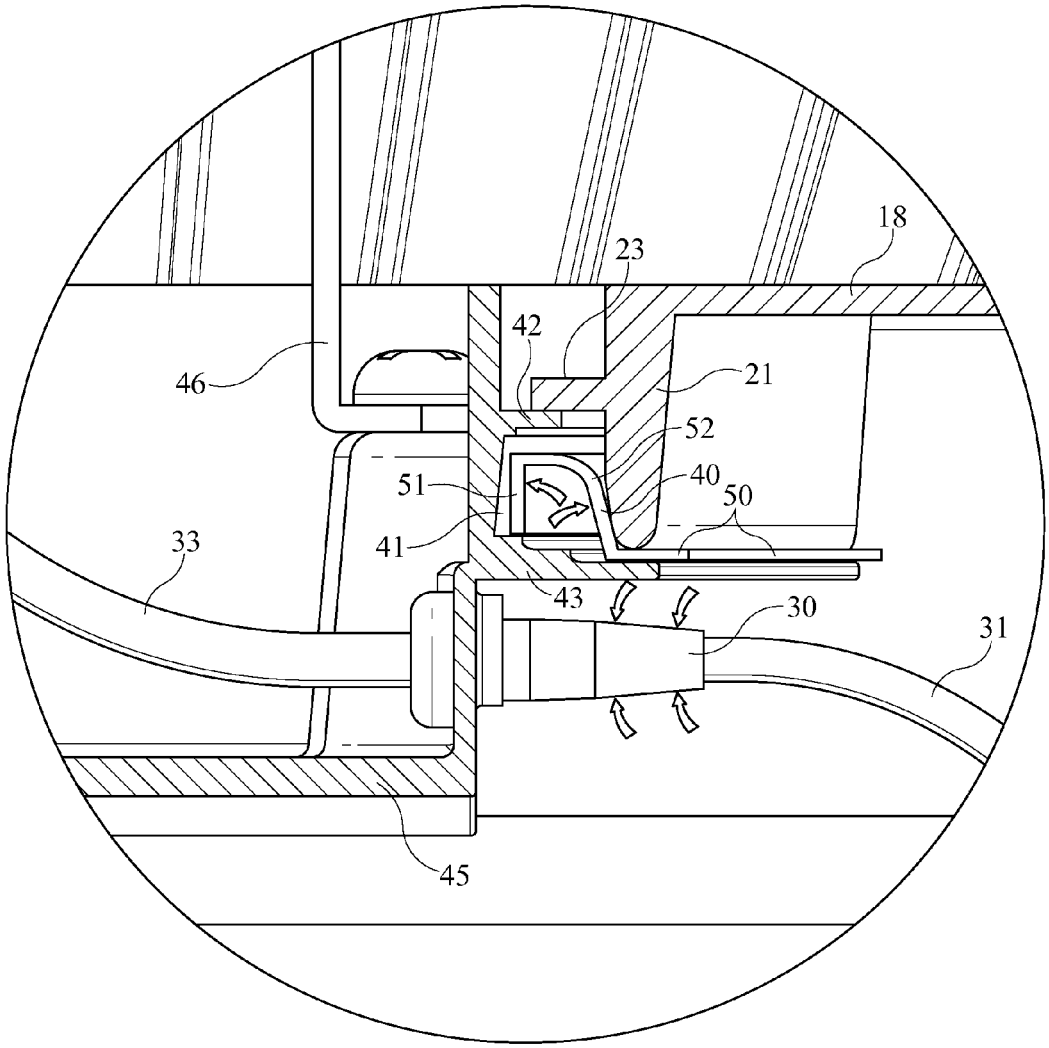
FIG. 5 is a close-up side-sectional view of the intersection between the lamp support base and the mounting collar for the sealed acorn luminaire of the present invention; and, FIG. 6 is an exploded view of the sealed acorn luminaire of the present invention.

The sealed acorn luminaire 10 of the present invention is depicted in FIG. 1 and is comprised of a globe 20 which has mounted therein a reflector 13 and which is topped by a globe top 14, the globe and globe top being integral or separate as desired. The globe 20 has an open bottom which is permanently sealed to a mounting collar 18, the mounting collar 18 permanently sealed or affixed and adhered to the bottom open aperture of the globe 20, the mounting collar 18 hingedly attached by hinge 12 to the ballast housing 133 positioned at the top of a lamp post. The mounting collar 18 is permanently and fixedly attached to the bottom open aperture lip of the globe 20 such that a permanent seal exist between the mounting collar 18 and the globe 20 and no airflow for contaminates is allowed to penetrate between the two structures. The mounting collar 18 has an interior aperture defined by a depending mounting collar extension 21 which, in this embodiment, extends downwardly from the inner periphery of the mounting collar as is depicted in FIG. 5 in order to sealingly engage the lamp support base 45. As shown in FIG. 1, the lamp support base 45 is received within the aperture defined by the mounting collar extension 21 such that part of the lamp support base 45, lamp stem or lamp support 46 and lamp 47 are positioned within the globe 20. The lamp support base 45 may be locked in place within the mounting collar aperture utilizing a number of known locking techniques such as rotation tabs 61 which may fit within openings formed in the mounting collar rim 23 shown in FIG. 5. Thus, the lamp support base may be locked in place by rotating the lamp support base 45 such that the tab 61 rides over the top of mounting collar rim 23 and prevents removal of the lamp support base 45 and which also provides sufficient clearance to induce adequate compression on seals maintained on the lamp support base 45.

The sealed acorn luminaire 10 of the present invention provides a sealing mechanism wherein a one-way outflow seal is provided in-between the lamp support base 45 and the mounting collar 18 such that heated gases generated when the lamp 47 is on may escape the interior portion of the globe 20 which may define the optical system of the sealed acorn luminaire 10. The design of the present embodiment is such that outflow of heated gases may be allowed during heating of the sealed acorn luminaire 10 but wherein the one-way outflow seal or shutter seal 40 only allows outflow of gases and significantly restricts the inflow of air or other contaminates during the cooling cycle. Inflow of air during the cooling cycle of the sealed acorn luminaire 10 after the lamp 47 has been turned off is controlled and may be restricted through the use of wire seal grommet 30 thereby significantly restricting and controlling the seal around the optical system. The wires entering into the system are sealed in order to permit air to penetrate the wire grommet seal with a very high restriction value ensuring that only air and molecules having the same dimension as air or smaller will have a chance to penetrate the optical system of the present sealed acorn luminaire.

Figure 2:
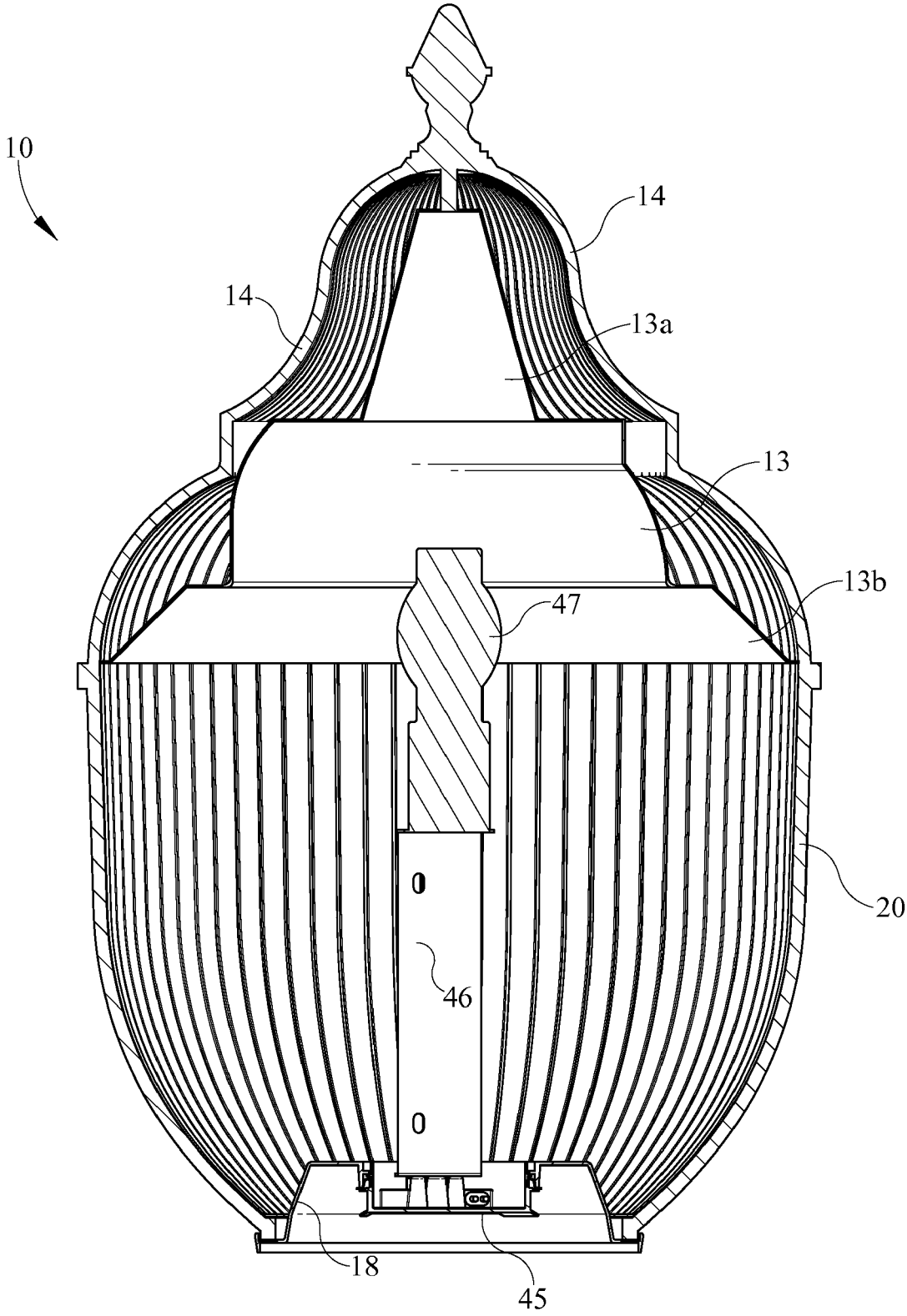
FIG. 2 is a side-section view of the sealed acorn luminaire of the present invention.
Figure 3:
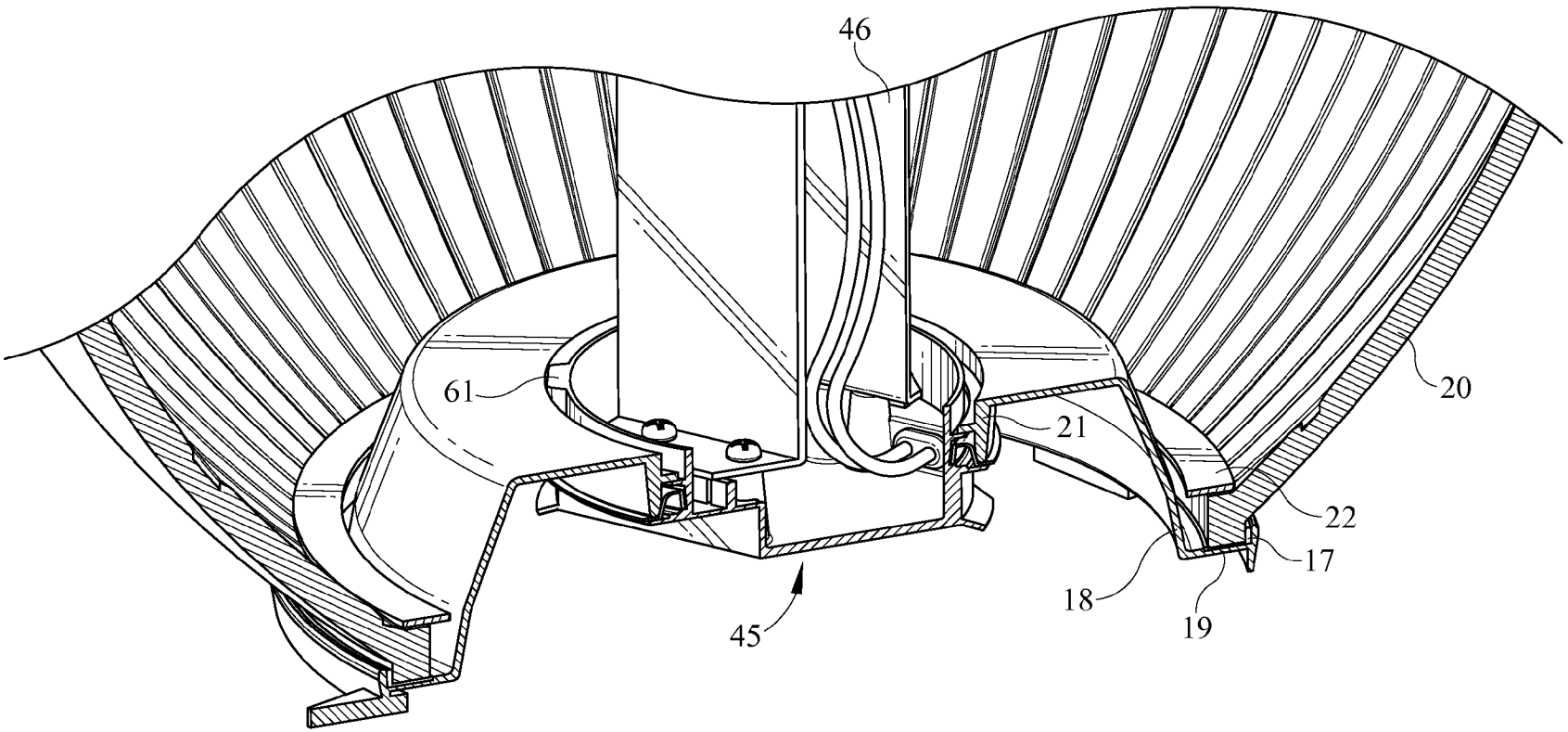
FIG. 3 is a close-up perspective view of the lamp support base and mounting collar for the sealed acorn luminaire of the present invention.
Figure 6:
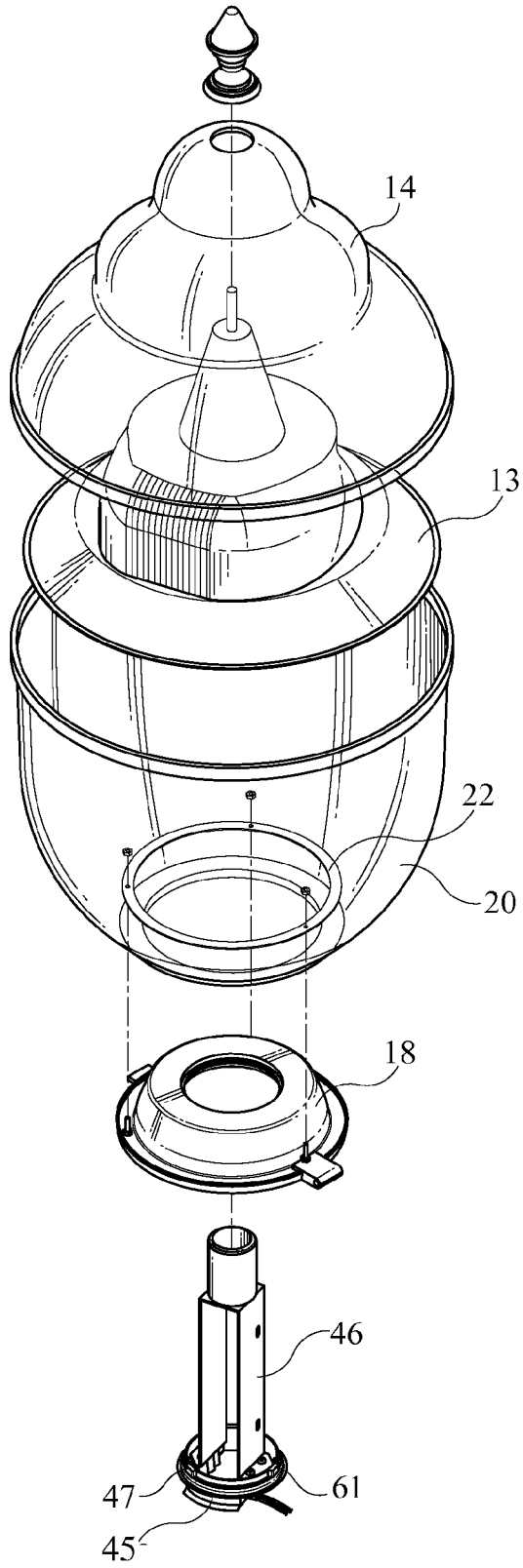

Turning to the design of the sealed acorn luminaire of the present invention, the globe 20 has globe top 14 and may have an internal reflector 13 as shown in FIG. 1 and FIG. 2. The globe is sealed along a lower periphery thereof to the mounting collar 18 having a permanent seal 17 positioned between the mounting collar seat 18 and the bottom edge or lip of the globe 20. The globe 20 may be pressed onto the mounting collar seat 19 or the mounting collar 18 through the globe retaining ring 22 which, as seen in FIG. 3 and FIG. 6, is an annular ring which presses downwardly on the lower portion of the globe 20 in order for it to maintain pressured contact with the mounting collar 18. The mounting collar permanent seal 17 between the mounting collar 18 and the globe 20 may be silicone material in order to permanently seal and prevent airflow or contaminate flow between the mounting collar and the globe thereby adequately and permanently sealing the joint between the structures. The globe retaining ring 22 may have a number of apertures for receiving retaining pins or bolts for maintaining adequate pressure and compressive forces on the globe and the mounting collar.

As shown in FIG. 1, received within the mounting collar aperture is the lamp support base 45 which supports the stem 46 and lamp 47 such that the lamp 47 may be contained in proper orientation within the globe 20 and particularly with respect to the reflector system 13 depicted herein. In the sealed acorn luminaire design depicted, the optical system retained within the globe 20 is permanently sealed except for the lamp access shutter seal that uses a reusable silicone shutter seal 40 to guarantee the continued seal over an extended length of time regardless of the quantity of lamp changes that has occurred. The sealing mechanisms described provide for the sealed acorn luminaire of the present invention to ensure that no water or dust can penetrate the optical system even during the cooling stages which cause negative pressure between the globe and the exterior atmosphere. The negative pressure event tries to force dust and moisture around the luminaire into the interior of the optical system through the seals. Breathing of the optical system occurs but is controlled and restricted by the seals around the wire seal grommet 30.

Referring specifically to FIG. 1, an annular shutter seal 40 is provided which seals the point of contact between the lamp support base 45 and the mounting collar 18. Particularly, turning to FIG. 4 and to FIG. 5, the mounting collar has a downwardly extending mounting collar extension 21 for engagement of the seal 40 positioned on the lamp support base 45. The lamp support base 45 has an annular seal channel 41 which is defined by an upper seal wall 42 and a lower seal wall 43, the seal channel 41 receiving the shutter seal 40 therein. The shutter seal 40 is placed within the seal channel and maintained in position on the lamp support base. As depicted in the present embodiment, the shutter seal 40 is annular but may have many different shapes as is known in the art. The lamp support base seal channel 41 receives the shutter seal and maintains the position of the shutter seal therein through the use of friction fit, adhesives or other known mechanisms. The interface between the lamp support base 45 and in particular the seal channel 41 and the mounting collar 18, and particularly the mounting collar extension 21, is shown in FIG. 5 wherein the mounting collar extension 21 extends downwardly and contacts the shutter seal 40.

The shutter seal 40 is designed to have an upstanding wall section 51 which is adjacent to the base of the lamp support base seal channel 41, a generally flat washer section 50 and a curved section extending between the washer section 50 and the upstanding wall section 51, the generally curved section 52 interposed therebetween. The washer section 50 of the shutter seal 40 is positioned between the mounting collar extension 21 and the lower seal channel wall 43 and the design interface between the lamp support base 45, mounting collar 18 and the shutter seal 40 is such that outflow of heated gases is allowed through the shutter seal 40 but that inflow pressure caused by cooling of the lamp and internal space of the globe 20 increases the sealing pressure shown in FIG. 5 thereby creating a one-way shutter seal and preventing or restricting flow of gases and other contaminates into the globe through the shutter seal 40. As indicated, hot air or other gas is created during the positive pressure outflow heating cycle, the outflow occurs through the shutter seal 40 and around the mounting collar extension 21 but inflow of gases, air and other contaminates is restricted due to the increased pressure on the shutter seal walls shown in FIG. 5 by the arrows. The flexible silicone shutter seal 40 may be comprised of many different materials, however, silicone may be utilized since it assures the seal between the shutter and the mounting collar has no memory loss and allows resealing once reassembled on the collar after maintenance. During the positive pressure cycle, temperature inside the globe increases and positive pressure forces some air to be expelled from the optical system maintained within the globe 20 through the flexible silicone seal 40 and potentially through the wire seal grommet 30 until the pressure inside the globe 20 and the exterior air equalizes. The shutter seal 40 is designed, as depicted with the current structure set forth herein, as a one-way seal or valve in order to provide some resistance to air exiting the optical system but providing significant resistance to incoming air as shown in FIG. 5.

In reference to the figures, one embodiment is depicted implementing the one-way outflow valve or seal 40 set forth herein, wherein the seal 40 is pinched between the mounting collar extension 21 which extends downwardly from an upper peripheral flange towards the lamp support base 45. Generally, utilization of a one-way outflow seal or valve as depicted and may implemented in many different structures which would necessarily allow outflow of increased pressure gases contained with the globe 20 after initiation or starting of the high intensity discharge lamp or induction lamp 47. Outflow of gas, as previously indicated, may be exhibited through the shutter seal 40 and possibly through the wire seal grommet 30 which connects the electrical wiring 31 to the internal wiring 33 on the other side of the lamp support base 45. In the present embodiment as depicted in FIG. 5, the mounting collar extension 21 pressures the shutter seal 40 and particularly the flat annular portion 50 of the shutter seal between the mounting collar structure and the lamp support base structure. Many different implementations of such a valve seal may be utilized and the disclosure set forth herein is intended to cover such implementations and alternative constructions for one-way outflow valve sealing mechanisms which may be utilized and interposed between the lamp support base 45 and the mounting collar 18. Additionally, while implemented in the embodiment depicted, a seal channel is formed for receptively and frictionally retaining the seal 40 within the proper location of the lamp support base 45. However, many different constructions for retention of the one-way valve seal 40 depicted may be implemented but not necessarily requiring a seal channel or upper and lower seal walls to trap the valve seal in position as is disclosed in this embodiment. Multiple embodiments may be interpreted from the various disclosures herein and the examples given are not to be construed as being limiting as one of ordinary skill in the art will interpret the inclusion of the valve seal construction between the lamp support base and the mounting collar in many different constructions and form.

In conjunction with the outflow valve seal 40 depicted in the figures, an inflow valve may also be utilized. Outflow valving may be necessary during heating of the luminaire caused by turning the lamp 47 on. The heated gases may then escape the sealed compartment of the optical chamber contained within the globe 20 so as to equalize the pressure from the interior of the globe 20 to the exterior environmental atmosphere pressure. Alternatively, upon turning off the lamp 47 of the luminaire, cooling of the air within the optical system and interior of the globe again causes disequilibrium thereby initiating potential inflow of air and other contaminates into the interior of the globe and the optical assembly. Due to the expansion as the joint expands during cooling of the luminaire of the one-way valve assembly 40 shown herein, inflow pressure depicted in FIG. 5 tightens the one-way outflow seal 40 and prevents the inflow into the globe and optical assembly of air and other contaminates through this valve. Breathing of the luminaire optical system of the present invention and inflow of air to equalize the pressure contained within the luminaire optical assembly and within the globe during such a negative pressure event may be accomplished through a one-way inflow valving mechanism implemented through the wire seal grommet 30 which surrounds the electrical wiring 31 on the exterior of the lamp support base 45. Wire seal grommet 30 has, at a location adjacent to the side wall of the lamp support base 45, a grommet composed of silicone or other similar valve and seal material which is designed to allow the controlled inflow of air into the interior of the globe and optical assembly area during a negative pressure event wherein comparative negative pressure is present in the interior of the globe relative to the exterior of the globe as a result of cooling. The cooling of the interior space of the globe therefore naturally creates the negative pressure in the interior of the globe assembly due to the seals located at all junction points and the inflow of air and other material is controlled through the wire seal grommet 30 due to the inability of air and other contaminates to enter into the globe space through the outflow shutter seal 40. The wire seal grommet 30 may control the inflow of air through the use of a silicone material to form the grommet and the sealing area around the aperture formed in the side wall of the lamp support base 45 through which the wires extend. The amount of inflow of the air during a negative pressure event as indicated, can be controlled through the angle, thickness and length of the wire seal grommet 30 extending along the electrical wiring 31. As shown in FIG. 5, the wire seal grommet 30 may extend along a predetermined length of the electrical wiring 31 and possibly into the interior of the lamp support base 45 contacting wiring 33 on the interior thereof The wire seal grommet 30 has a sufficient length and sufficient thickness along the wiring and at the aperture of the lamp support base through which the electrical wiring extends in order to allow breathing of the optical system to occur but controls and restricts the inflow of air into the optical system and the internal area defined by the globe. The wire seal grommet 30 of the present invention is designed so as to permit air to penetrate having an R factor of about 600 or a relative high restriction value such that only air and molecules having the same dimension as air or smaller will have a chance to penetrate into the interior of the optical system. The R factor is the reistance to air flow, defined by the following formula: R=h/CFM where R is the air resistance, h is the pressure measured in inches of water and CFM is the flow rate in cubic feet per minute. The wire seal grommet 30 of the present invention may be designed to control the amount of inflow air into the system by alternating the construction of the grommet itself, the elements of which is made, modifying the thickness thereof or extending the length of the grommet along the electrical wiring.

Figure 4:
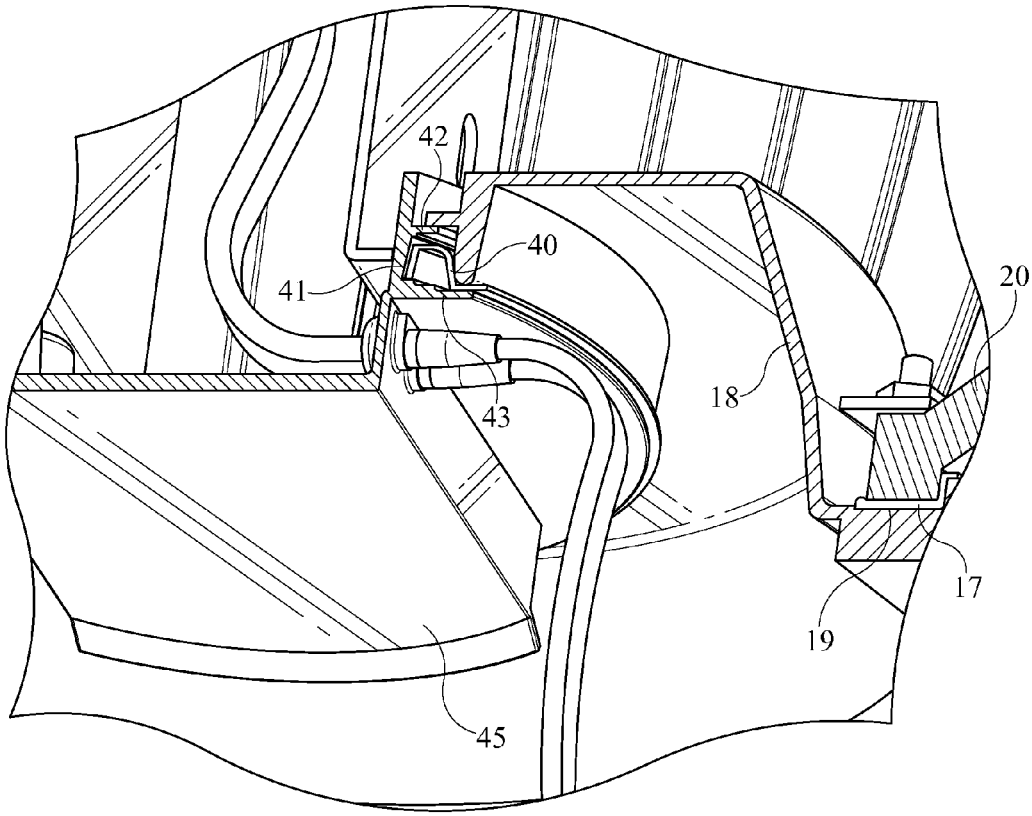
FIG. 4 is a lower perspective view of the intersection between the lamp support base and the mounting collar of the sealed acorn luminaire of the present invention.

As shown in FIG. 4, individual or separate wire seal grommets may be provided through the dual wires which enter into the interior of the luminaire and particularly through the lamp support base 45 as shown. Each of these grommets may extend around the individual wires as they approach the wall of the lamp support base but may be conjoined through a single silicone seal on the interior wall of the lamp support base 45 as is shown in FIG. 3. Alternative constructions however may be implemented in order to maintain and control the inflow of air during the negative pressure event as depicted and discussed herein. The seals are designed so as to create a strong seal as inside pressure decreases during a cool down cycle thus exerting a greater restriction on incoming air and contaminates coming from the outside as shown in FIG. 5, thereby increasing the sealing functionality of the shutter seal 40 during a negative pressure event while allowing the inflow of air through the wire seal grommet 30 described herein.

As shown in FIG. 1, the lamp stem 46 extends the lamp 47 upward and into the interior of the globe and positions it as necessary relative to the reflector system 13 including the lower reflector collar 13*b* and the conical reflector 13*a*. Primary reflector interposed in-between the conical reflector 13*a* and lower reflector collar 13*b* works in combination with the entire reflector system 13 in order to provide an adequate cutoff designation for the acorn style luminaire thereby providing a cutoff distribution having less than a predetermined amount of candelas per 1,000 lamp lumens at angles of 90 degrees and above and, said predetermined level of candelas being at or about 25. Further, less than 100 candelas per 1,000 lamp lumens may be emitted at angles of 80 degrees from nadir and having an up light contribution of less than 2 percent of luminaire lumens output depending upon the specific construction of the cutoff reflector depicted, the type of refractor or reflector utilized in combination with the formation of prisms on the interior or exterior of the globe and other unique features used in combination with the high efficacy reflector and light transmitting vertical internal prismatic globe which may be utilized.

The lamp 47 shown herein may be a high intensity discharge lamp such as high pressure sodium on metal halides having a wattage output of up to 250 W. As shown in FIG. 2, the lamp 47 is depicted as being substantially surrounded by the reflector system 13 of the acorn luminaire shown. The lamp support stem 46 may be affixed to the lamp support base 45 through the utilization of attachment mechanisms, screws, adhesives or other known mechanisms known to those skilled in the art. Alternative structures may be implemented in order to position the lamp in proper orientation with respect to the reflector as desired and as is known. As shown in FIG. 6, the combined construction of the acorn luminaire of the present embodiment may be implemented through the use of the top portion of the luminaire acorn luminaire 14 having the reflector system 13 included, affixed or held therein, the globe 20 held in place through the retention ring 22 on top of the mounting collar 18 with the lamp support stem 45 inserted and retained therein through known retention mechanisms and techniques. It is to be understood that the general concepts and examples provided herein are utilized as exemplary only in order to provide a better understanding of the novel features of the sealed acorn luminaire described and claimed in the appended claims. Many alternative constructions for the various structures and embodiments depicted herein may become known to one of ordinary skill in the art after review of the entire disclosure, drawings and claims attached hereto.

I claim:

1. A sealed acorn shaped luminaire, comprising:

a globe surrounding an enclosed space and mounted on a mounting collar, said mounting collar hingedly connected to a lamp post;

a reflector positioned within said globe for reflecting light emitted by a light source; said light source affixed to a stem, said stem extending upward from a lamp support base into said globe sufficient to position said light source in reflective relationship with said reflector;

said mounting collar having an aperture;

a lamp support base removably affixable in said aperture of said mounting collar and providing separated, restricted and controlled inflow and outflow of air into said enclosed space, said lamp support base having a one-way outflow shutter seal at a point of contact between said base and said mounting collar allowing outflow of air through said base and mounting collar juncture during pressurization of said globe, and lamp support base supporting a lamp within said globe;

electrical wiring extending through said lamp support base to said light source;

a one-way inflow electrical grommet seal on said lamp support base which significantly restricts the inflow of air and other particles into said enclosed space.

2. The sealed acorn luminaire of claim 1 wherein said one-way outflow seal is located on a periphery of said lamp support base.

3. The sealed acorn luminaire of claim 2 wherein said lamp support base is annular.

4. The sealed acorn luminaire of claim 3 wherein said lamp support base is rotatably locked into place onto said mounting collar.

5. The sealed acorn luminaire of claim 1 wherein said lamp support base has a peripheral seal channel which receives said one-way outflow seal.

6. The sealed acorn luminaire of claim 5 wherein said one-way outflow seal has a washer section positioned between said lamp support base and said mounting collar.

7. The sealed acorn luminaire of claim 6 wherein said one-way outflow seal has an upstanding wall section with a curved section positioned between said upstanding wall section and said flat washer section.

8. The sealed acorn luminaire of claim 1 wherein said wire grommet seal permits air to penetrate into the interior of said luminaire with an R factor of about 600.

9. A sealed acorn shaped luminaire which restricts the inflow of dirt and dust into a globe, comprising:

a globe permanently seated and sealed on a mounting collar with a permanent seal interposed between said globe and said mounting collar;

said mounting collar having a removable lamp support base affixed to a lamp for supporting said lamp within said globe;

a reflector positioned within said globe for reflecting light emitted by said lamp; said lamp affixed to a stem, said stem extending upward from said lamp support base into said globe sufficient to position said light source in reflective relationship with said reflector;

said lamp support base having a peripheral one-way outflow shutter valve contacting said mounting collar allowing outflow of air between said lamp support base and said mounting collar during pressurization of said globe;

electrical wiring entering through a one-way wire inflow seal grommet on said lamp support base, said electrical wiring and electrical contact with said lamp.

10. The sealed acorn luminaire of claim 9 wherein said lamp support base has a periphery which has a seal channel for receiving said one-way outflow seal.

11. The sealed acorn luminaire of claim 10 wherein said one-way outflow seal has a flat washer section.

12. The sealed acorn luminaire of claim 11 wherein said flat washer section is compressed between a lower seal channel wall and said mounting collar.

13. The sealed acorn luminaire of claim 12 wherein said one-way outflow seal has a curved section extending between said flat washer section and an upstanding wall section.

14. The sealed acorn luminaire of claim 9 wherein said mounting collar has an inner-periphery mounting collar extension extending downward against a lower seal channel wall formed on said lamp support base and compressing said one way outflow valve there between.

15. The sealed acorn luminaire of claim 9 wherein said wire seal grommet controls inflow of air into said globe by allowing air to penetrate into said globe with an R factor of 600.

16. The sealed acorn luminaire of claim 9 wherein said wire seal grommet restricts the inflow of air and other contaminates into said globe to ensure that only air and molecules having similar dimensions as air or smaller will penetrate into said globe.

17. A sealed acorn luminaire which prevents dust and water from penetrating the optical system of the luminaire, comprising:

an acorn style globe having a mounting collar, said mounting collar forming an open aperture, said globe and mounting collar defining an enclosed space interior of said globe, said globe made of a light transmissive material;

a reflector positioned within said globe at a top end for reflecting light emitted by a light source;

said light source affixed to a lamp stem, said lamp stem extending upward from a lamp support base into said globe and positioning said light source in reflective relationship with said reflector;

said lamp support base removably insertable into said aperture of said mounting collar and removably lockable therein;

a one-way outflow shutter valve seal interposed between said lamp support base and said mounting collar allowing outflow of air between said lamp support base and said mounting collar during internal heating of said globe;

electrical wiring extending through said lamp support base into said light source, said electrical wiring extending through a side wall of said lamp support base;

a wire seal grommet substantially surrounding said electrical wiring at a point where said electrical wiring extends through said lamp support base side wall, said wire seal grommet controlling and restricting the inflow of air into said globe during a negative pressure event such that air penetrates through said wire seal grommet and into said globe at a predefined controlled rate.

18. The sealed acorn luminaire of claim 17 wherein said shutter valve is located on a peripheral edge of said lamp support base and has a washer section which seals between said mounting collar and said lamp support base.

19. The sealed acorn luminaire of claim 17 wherein said wire seal grommet is a silicone grommet extending around said electrical wiring and through said aperture and said side wall of said lamp support base, the thickness and length of said wire seal grommet being of a predetermined thickness and a predetermined length to control and restrict said air inflow into said acorn sealed luminaire globe.

20. The sealed acorn luminaire of claim 18 wherein said shutter valve is positioned along a peripheral edge of said lamp support base within a seal channel, said mounting collar having a downwardly extending extension extending toward said shutter valve compressing or positioning said shutter valve between said mounting collar extension and a side wall of said seal channel.

21. A sealed acorn style luminaire, comprising:

a globe having an interior reflector positioned along an upper end, said globe having a mounting collar along a lower end, said globe and said mounting collar permanently sealed together, said mounting collar hingedly attached to a lamp post and having an aperture formed centrally therein for receiving a lamp support base, said lamp support base removably lockable in said central aperture and positioning a light source internally within said globe when said lamp support bases locks into said mounting collar, said lamp support base having a one-way outflow shutter type valve seal along a peripheral edge thereof allowing outflow of gases between said lamp support base and said mounting collar but restricting inflow of air and other material into said globe between said mounting collar and said lamp support base;

electrical wiring extending through said lamp support base and to said light source through an aperture on a wall of said lamp support base, said wiring extending through said aperture and surrounded by a wire seal grommet at said aperture, said wire seal grommet restricting and controlling the inflow of gases into said globe when said lamp support base is locked into said mounting collar and when said globe is undergoing a negative pressure event such that the inflow of gases into said sealed acorn luminaire is restricted and controlled through said wire seal grommet.

* * * * *